US009207641B2

(12) United States Patent
Henein et al.

(10) Patent No.: US 9,207,641 B2
(45) Date of Patent: Dec. 8, 2015

(54) TIMEPIECE OSCILLATOR

(71) Applicant: CSEM Centre Suisse d'Electronique et de Microtechnique SA -Recherche et Développement, Neuchêtel (CH)

(72) Inventors: Simon Henein, Neuchatel (CH); Ivar Kjelberg, Yverdon-les-Bains (NO)

(73) Assignee: CSEM CENTRE SUISSE D'ELECTRONIQUE ET DE MICROTECHNIQUE SA—RECHERCHE ET DEVELOPPEMENT, Neuchatel (CH)

( * ) Notice: Subject to any disclaimer, the term of this patent is extended or adjusted under 35 U.S.C. 154(b) by 0 days.

(21) Appl. No.: 14/627,953

(22) Filed: Feb. 20, 2015

(65) Prior Publication Data

US 2015/0234354 A1 Aug. 20, 2015

(30) Foreign Application Priority Data

Feb. 20, 2014 (CH) ..... CH0230/14

(51) Int. Cl.
*G04B 17/04* (2006.01)
*G04B 17/10* (2006.01)

(52) U.S. Cl.
CPC ..... *G04B 17/045* (2013.01); *G04B 17/04* (2013.01); *G04B 17/10* (2013.01)

(58) Field of Classification Search
CPC ..... G04B 17/04; G04B 17/045; G04B 17/06; G04B 17/10
USPC ..... 368/127–133, 168–170
See application file for complete search history.

(56) References Cited

U.S. PATENT DOCUMENTS

| | | | | |
|---|---|---|---|---|
| 2,531,273 | A * | 11/1950 | Philippe | 368/127 |
| 3,318,087 | A | 5/1967 | Favre | |
| 7,963,693 | B2 * | 6/2011 | Genequand | 368/170 |
| 9,075,394 | B2 * | 7/2015 | Stranczl et al. | 1/1 |

FOREIGN PATENT DOCUMENTS

| | | | |
|---|---|---|---|
| CH | 452443 | A | 5/1968 |
| EP | 1736838 | A1 | 12/2006 |
| EP | 2090941 | A1 | 8/2009 |
| EP | 2273323 | A2 | 1/2011 |
| WO | WO 2012/010408 | A1 | 1/2012 |

OTHER PUBLICATIONS

European Search Report (EPO Form 1503) for EP14156053.

* cited by examiner

*Primary Examiner* — Vit W Miska
(74) *Attorney, Agent, or Firm* — Koppel, Patrick, Heybl & Philpott

(57) ABSTRACT

The invention relates to a rotating oscillator for a timepiece comprising a support element designed to allow the oscillator to be assembled on a timepiece, a balance, a plurality of flexible blades connecting the support element to the balance and able to exert a return torque on the balance, and a felloe mounted secured to the balance. The plurality of flexible blades comprises at least two flexible blades, including a first blade positioned in a first plane perpendicular to the plane of the oscillator, and a second blade positioned in a second plane perpendicular to the plane of the oscillator and intersecting the first plane. The geometric oscillation axis of the oscillator is defined by the intersection of the first plane and the second plane, said geometric oscillation axis crossing the first and second blades at ⅞th of their respective lengths.

20 Claims, 4 Drawing Sheets

TIMEPIECE OSCILLATOR

RELATED APPLICATIONS

The present application claims priority to Swiss patent application CH00230/14, filed Feb. 20, 2014 and European patent application EP14156053.2 filed Feb. 20, 2014. The applications referred to in this paragraph are incorporated by reference as set forth fully herein.

TECHNICAL FIELD

The present invention relates to the field of mechanical horology. It more particularly relates to a rotating oscillator with a virtual pivot that comprises:

- a support element designed to allow the oscillator to be assembled on a timepiece,
- a balance,
- a plurality of flexible blades connecting the support element to the balance, and
- a felloe mounted secured to the balance.

BACKGROUND OF THE INVENTION

In mechanical watches, time is broken down into fractions by a regulating member that today is usually a sprung balance. The latter is made up of three main parts: the balance, which acts as an inertia wheel; an arbor ending with pivot, which makes it possible to mount the balance in a timepiece frame; and a balance spring that produces a return torque proportional to the angular travel of the balance.

Reducing friction of the pivots allows a direct reduction of their wear, as well as an improved power reserve of the watch. Considerable work has been done on the subject, regarding the optimization of the bearings or lubrication of the pivot zones.

More recently, application EP 1,736,838, in the applicant's name, described an oscillator with no pivot, comprising an inertia wheel centered on the geometric oscillation axis of the oscillator, that wheel being connected to the frame of the movement by four springs, deforming during the oscillation and acting as the balance spring. The system, which is particularly interesting to reduce friction, since it does not comprise a pivot, is nevertheless limited. On the one hand, its oscillation amplitude is limited, less than or equal to 5°. On the other hand, the guiding offered by the flexible blades is not optimal, the geometric oscillation axis being able to suffer disruptions, by undergoing micro-movements, influencing the isochronism of the adjusting member.

The present invention aims to propose an oscillator providing the advantages of the systems of the state of the art, but at least partially free of their drawbacks. Brief description of the invention To that end, the invention relates to a rotating oscillator with a virtual pivot, i.e., with no physical pivot in the usual sense of the term, which comprises a support element designed to allow the oscillator to be assembled on a timepiece, a balance, a plurality of flexible blades connecting the support element to the balance able to exert a return torque on the balance, and a felloe mounted secured to the balance.

According to the invention, the plurality of flexible blades comprises at least two flexible blades, a first blade of which is positioned in a first plane perpendicular to the plane of the oscillator, and a second blade that is positioned in a second plane perpendicular to the plane of the oscillator and intersecting the first plane, the first and second blades have an identical geometry, and in that the geometric oscillation axis of the oscillator is defined by the intersection of the first plane and the second plane, said geometric oscillation axis crossing the first and second blades at $7/8^{th}$ of their respective lengths.

Other advantageous features of the invention are defined in the claims.

Consequently, the invention makes it possible to provide an inherent rotation, i.e., in which the oscillation axis is stationary, and without friction, other than that with the air. Quality factors of the oscillator are thus obtained that are typically greater by an order of magnitude relative to the oscillators of the state of the art, which reflects a reduction in the damping of the oscillation. This unique rotation makes it possible to produce a return torque on the oscillator that is practically proportional to the angular travel. A mechanical oscillator is obtained capable of offering a great potential to increase the power reserve of a mechanical watch.

BRIEF DESCRIPTION OF THE DRAWINGS

The invention will be better understood upon reading the following description of embodiments, provided as an example and done in reference to the drawings, in which.

DETAILED DESCRIPTION OF THE INVENTION

Figure 1:
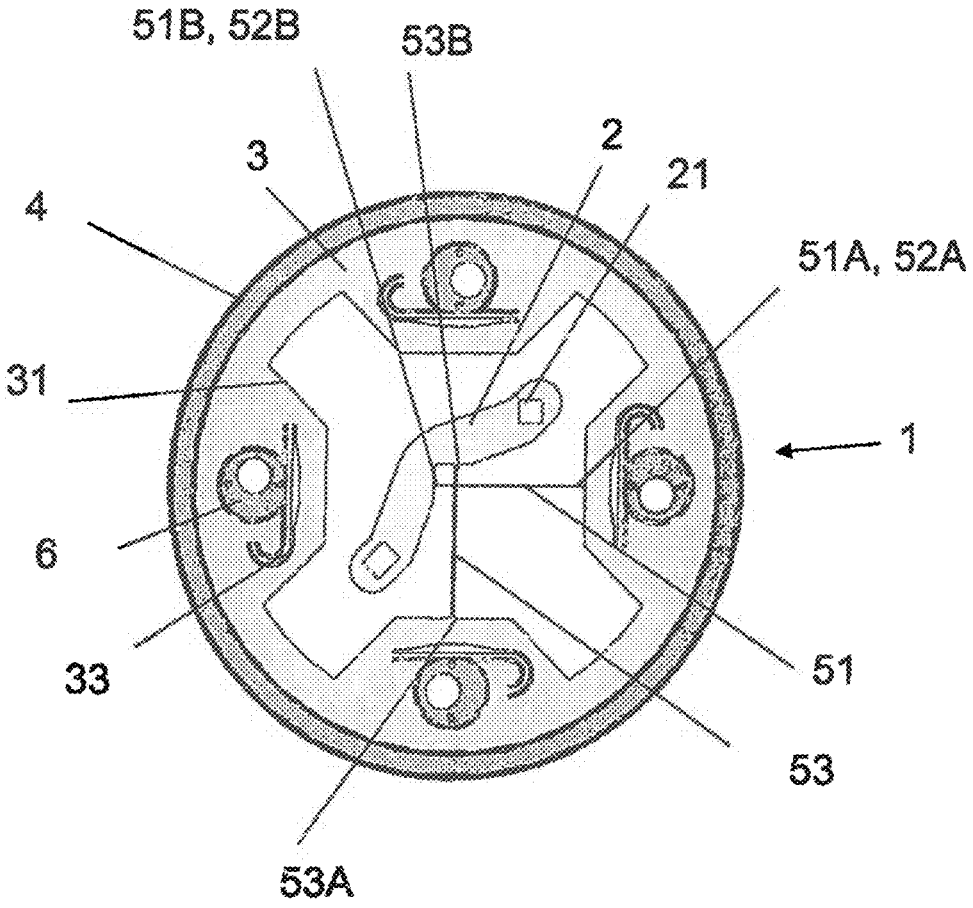
FIG. 1 shows a top view of the oscillator according to the invention.

FIG. 1 shows a rotating oscillator 1 for a timepiece according to the invention that comprises a support element 2 designed to allow it to be assembled on a frame (not shown) of a mechanical watch. The oscillator 1 also comprises a balance 3, which, in this example, comprises a circular element comprising a central opening, inside which the support element 2 is placed. The latter is situated in the plane of the balance 3, near the center of the balance 3 or its center of gravity in the case of a noncircular balance. The support element 2 is connected to the balance 3 by a plurality of flexible blades connecting the support element 2 to the balance 3. A felloe 4 is mounted secured to the balance 3 to provide sufficient inertia to the oscillator 1.

FIG. 1 shows a first embodiment of the invention, in which there are two flexible blades, including a first blade 51 positioned in a first plane perpendicular to the plane of the oscillator 1, and a second blade 53 positioned in a second plane perpendicular to the plane of the oscillator 1 and intersecting the first plane. The first 51 and second 53 blades advantageously have an identical geometry.

The height of the blades is defined as the dimension perpendicular to the plane of the balance 3. The length of the blade is naturally the dimension situated in the plane of the balance 3, along the longitudinal axis of the blade, and the thickness is the dimension perpendicular to the length, in the plane of the balance 3. The thickness is reduced so as to give the blades flexibility in the plane of the balance 3. The height of the blades is defined so as to offer sufficient stiffness to keep the balance 3 in the same plane as the support element 2 when the oscillator 1 is assembled on the frame.

The first and second planes intersect along a straight line that passes at $7/8^{th}$ of the length of each blade 51 and 53 and that defines a virtual oscillation axis 7 of the oscillator 1.

In terms of flexible structure, it has been shown that the configuration in which the flexible blades intersect at a point situated at $7/8^{th}$ of the length is optimal, since it makes it possible to obtain an inherent rotation with no friction around its virtual oscillation axis 7 and while minimizing the movement of said axis. Furthermore, such an oscillator 1 advantageously has a return torque practically proportional to the angular travel of the balance, which is typically 20°.

Figure 3:
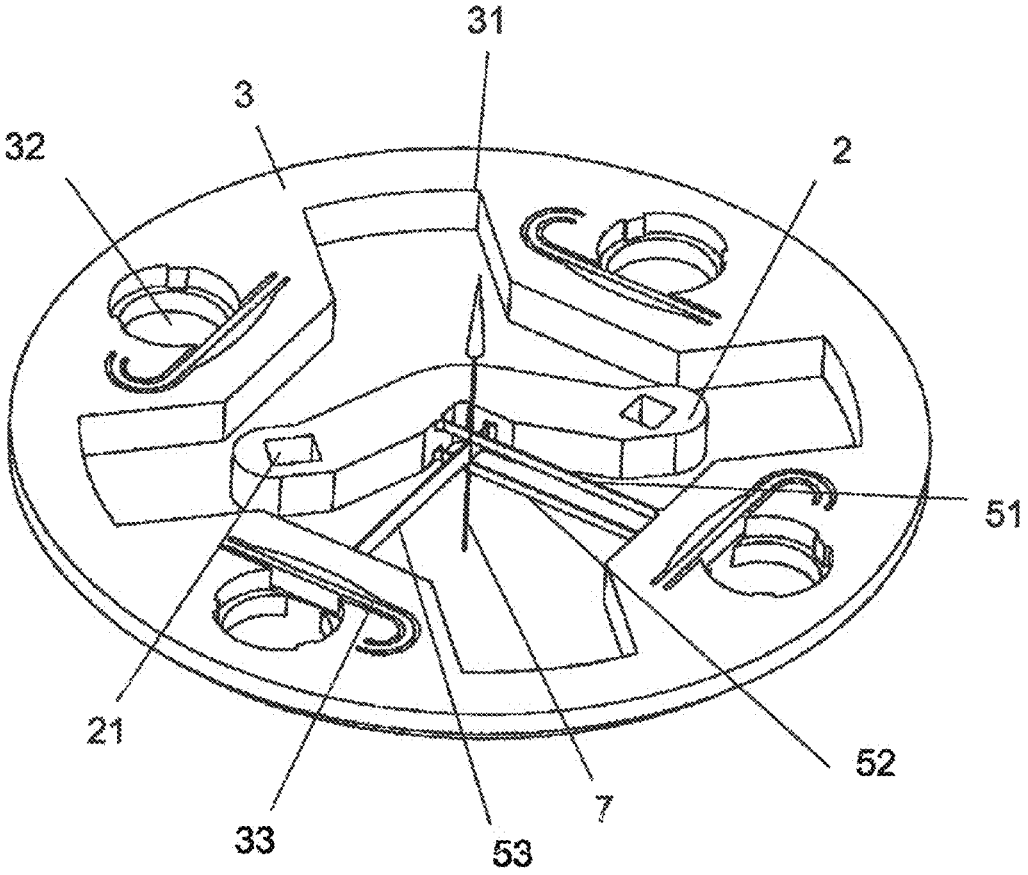
FIG. 3 is a perspective view of part of an oscillator according to a second embodiment.
Figure 4:
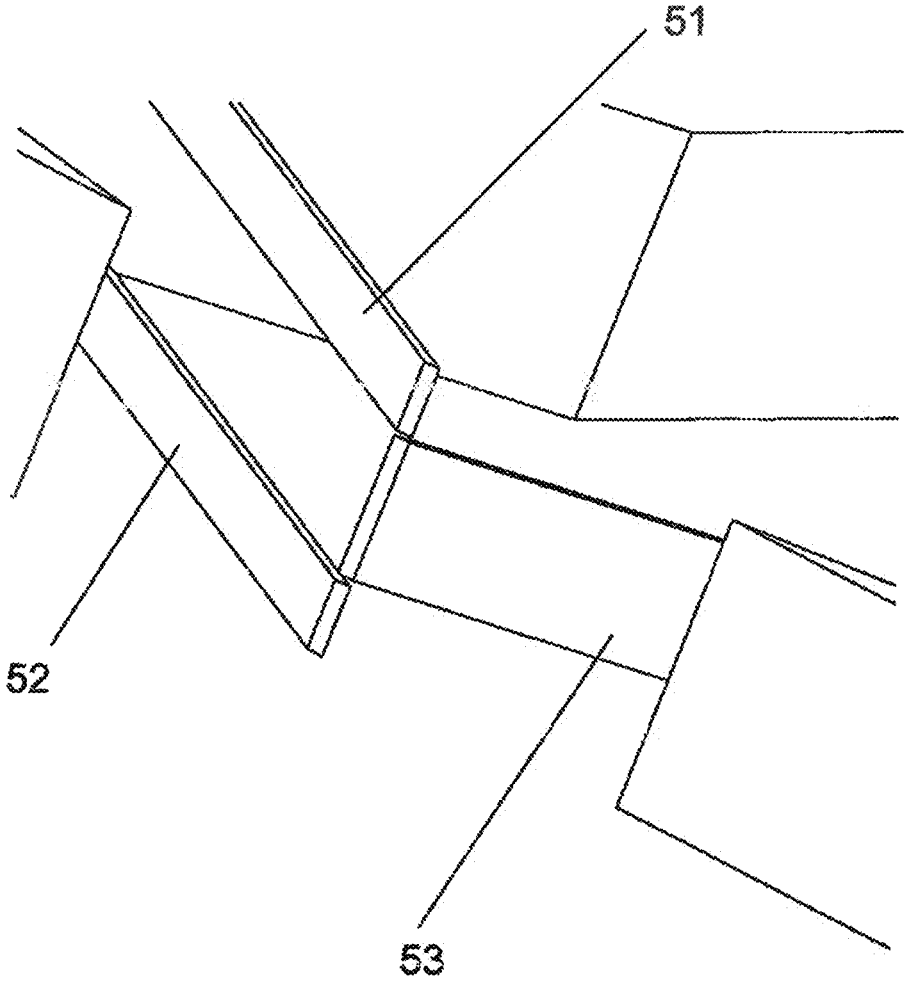
FIG. 4 shows a detail of FIG. 3.

In a second advantageous embodiment proposed in FIGS. 3 and 4, the plurality of flexible blades comprises a pair formed by a first 51 and second 52 blade that are positioned in the first plane perpendicular to the plane of the oscillator 1. The first 51 and second 52 blades have an identical geometry. The plurality of blades also comprises a third blade 53 positioned in the second plane perpendicular to the plane of the oscillator 1, and intersecting the first plane. The third blade 53 is intercalated between the first 51 and second 52 blades and has a height twice that of the first 51 or second 52 blade. FIG. 4 shows a side view of the flexible blades in which the arrangement of the flexible blades and the height difference of the blades is clearly shown.

Implementing a plurality of flexible blades, particularly in the configuration of the second embodiment, makes it possible to increase the out-of-plane stiffness of the virtual pivot. For a given stiffness of the virtual pivot around the virtual oscillation axis 7, the geometry of the blades is adapted so as to keep the stiffness of the pivot constant while preserving the symmetry of the stiffness relative to the mean plane of the balance.

The balance 3 has a shape allowing it to be centered and balanced around the geometric oscillation axis 7. Consequently, in the particular configuration illustrated as an example, if its outer perimeter is circular, its inner perimeter, which defines the central opening, defines a polygon of symmetry of order N around the virtual oscillation axis 7. At a first of their ends 51A, 52A and 53A, the blades are respectively positioned perpendicular to and in the middle of two sides of the polygon.

In the particular examples illustrated in the figures, the inner perimeter 31 of the balance 3 has a shape resulting from the superposition of a square and a Greek cross, the arms of which intersect at their middle and are equidistant, the axes of the arms of the cross passing through the corners of the square with identical arms whereof the corners of the square and the arms of the cross are aligned.

The support element 2 has two faces that are respectively substantially parallel to the two sides of the polygon receiving the blades, such that, at their second end 51B, 52B and 53B, the blades are also positioned perpendicular to the faces of the support element. They can also be positioned at the middle of said faces.

In the proposed configuration, the first and second planes containing the blades are perpendicular. In other words, the face of the support element 2 and the side of the polygon connecting a same blade are parallel.

The support element 2 makes it possible to assemble the oscillator 1 on the frame (not shown) of the mechanical watch, via fastening means 21, for example holes, that can also be configured so as to provide indexing means for the position of the oscillator 1.

The felloe 4 is positioned securely on the outer perimeter of the balance 3. It is made from a material with a density higher than the density of the material of the balance 3, in order to give the oscillator 1 sufficient inertia. In the proposed example, the felloe 4 is a ring, but it is possible to consider having a plurality of hammers, regularly distributed around the balance 3.

In order to adjust and potentially correct the balancing of the oscillator 1, the balance 3 comprises a plurality of housings 32, advantageously circular, each receiving an inertia-block 6. The housings 32 are regularly distributed on the balance 3, and positioned preferably equidistantly from the geometric oscillation axis 7. Each of the inertia-blocks 6 has a center of gravity positioned off-centered relative to each housing 32. Thus, by adjusting the angular position of the inertia-blocks 6 in their housing 32, it is possible to adjust the position of the center of gravity of the oscillator 1, such that it is probably centered on the geometric oscillation axis 7.

Figure 2:
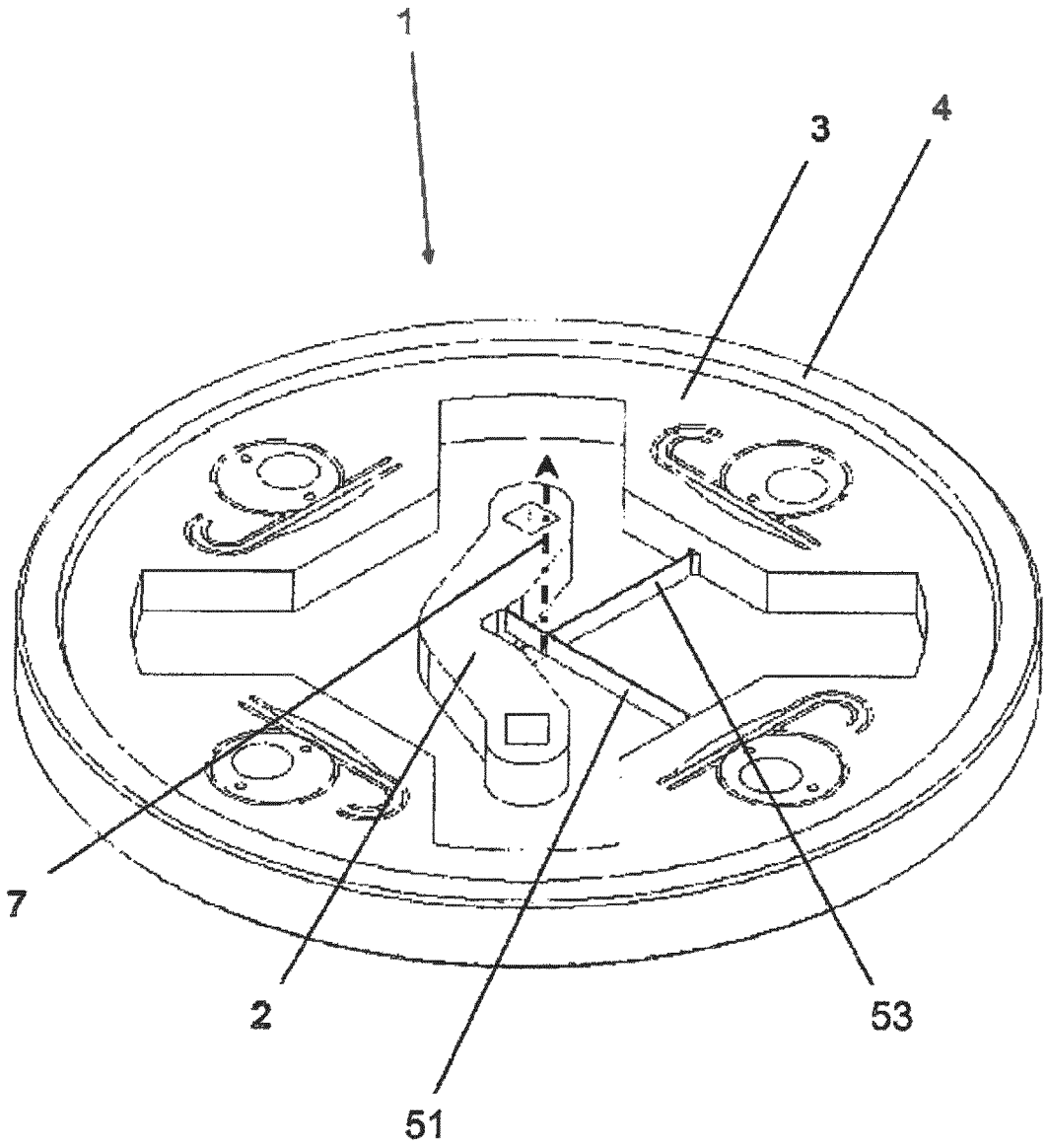
FIG. 2 shows a perspective view of part of an oscillator according to a first embodiment of the invention.

As can be better seen in FIG. 3, the balance 3 is structured so as to define, at each housing 32, an elastic element 33 at least partially placed in said housing 32. FIGS. 1 and 2 show the inertia-blocks 6 positioned in the housings 32. The elastic elements 33 make it possible to maintain the inertia-blocks 6, by exerting a pre-stress force on them generated by the deformation of the elastic elements 33 tending to keep the inertia-blocks 6 in their housing 32.

The felloe 4 and the inertia-blocks 6 may advantageously be made from a same material with a density higher than that of the material of the balance 3.

According to one particularly interesting aspect of the invention, the support element 2, the balance 3 including the elastic elements 3, and the flexible blades 51 and 53 or 51, 52 and 53, depending on the proposed cases, are manufactured monolithically. Such a microsystem 8, illustrated in FIG. 3, can be made from silicon, using detection techniques. It is thus possible to obtain the required precision for machining of the flexible blades 51, 52 and 53, which are typically only separated by several microns.

According to one embodiment of the invention, the microsystem 8 is made from silicon and the felloe 4 is made from gold. They are assembled at the wafer level by thermocompression. This allows a much more precise assembly than using conventional methods.

With a microsystem 8 made from silicon, it is possible to offset the thermal drift affecting the flexible blades of the oscillator 1, by coating the latter with a coating made from a material having a thermal coefficient of the Young's modulus that is the inverse of that of silicon.

One skilled in the art will know how to adapt the oscillator 1 described above so as to have, on the parts designed to be in motion, a member having the usual function of an impulse-pin, to cooperate with an escapement.

Furthermore, the number of flexible blades presented in the examples described above is not limiting, and one skilled in the art will be able to adapt the number of flexible blades and their arrangement depending on his needs. The maximum number of blades [will be] defined by a compromise between the bulk of the system (particularly from an aesthetic point of view) and the stability of the system.

It is thus easy to have 4 or 5 flexible blades that will be dimensioned and arranged such that the stiffness that they impart is arranged symmetrically relative to the mean plane of the balance.

For example, it is possible to have 4 identical flexible blades, positioned on either side of the mean plane of the balance, a first pair of these blades being in the first plane and a second pair of these blades being in the second plane mentioned above. The blades of a pair may be on the same side of the mean plane or on either side of that plane.

In a configuration with 5 blades, the embodiment with 3 blades will typically be used as a starting point, with one flexible blade situated in the first plane, intercalated between two pairs of flexible blades situated in the second plane, the sum of the heights of the flexible blades situated in the second plane being equal to the height of the flexible blades situated in the first plane.

The invention claimed is:

1. A rotating oscillator with a virtual pivot that comprises:
a support element designed to allow the oscillator to be assembled on a timepiece;
a balance;
a plurality of flexible blades connecting the support element to the balance;
wherein the plurality of flexible blades comprises at least two flexible blades, a first blade of which is positioned in a first plane perpendicular to the plane of the oscillator, and a second blade that is positioned in a second plane perpendicular to the plane of the oscillator and intersecting the first plane;
a felloe mounted secured to the balance; and
characterized wherein the geometric oscillation axis of the oscillator is defined by the intersection of the first plane and the second plane, said geometric oscillation axis crossing the first and second blades at $7/8^{th}$ of their respective lengths.

2. The rotating oscillator according to claim 1, wherein the plurality of flexible blades comprises:
a pair formed by first and second blades positioned in said first plane, the first and second blades having an identical geometry;
a third blade positioned in said second plane, said third blade being intercalated between the first and second blades and having a height twice that of the first or second blade.

3. The rotating oscillator according to claim 1, wherein the plurality of flexible blades comprises:
a first flexible blade positioned in said first plane; and
a second flexible blade identical to the first flexible blade, positioned in said second plane perpendicular to the plane of the oscillator.

4. The rotating oscillator according to one of claim 1, wherein the balance comprises a plurality of housings each receiving an inertia-block, said housings being regularly distributed on the balance, and positioned equidistantly from the geometric oscillation axis.

5. The rotating oscillator according to claim 4, wherein each of the inertia-blocks has a center of gravity positioned off-centered in each housing.

6. The rotating oscillator according to claim 4, wherein the balance is structured so as to define, at each housing, an elastic element at least partially placed in said housing.

7. The rotating oscillator according to claim 1, wherein the support element, the balance including the elastic elements, and the flexible blades are manufactured monolithically.

8. The rotating oscillator according to claim 7, wherein the support element, the balance including said elastic elements, and the flexible blades are made from silicon.

9. The rotating oscillator according to claim 8, wherein the flexible blades have a $SiO_2$ coating.

10. The rotating oscillator according to claim 9, wherein the thickness of the $SiO_2$ coating is determined so as to at least partially offset the thermal drift of the Young's modulus of the flexible strips.

11. The rotating oscillator according to claim 9, wherein the thickness of the $SiO_2$ coating is determined so as to at least partially offset the thermal drift of the inertia of the balance.

12. The rotating oscillator according to claim 1, wherein the felloe is made from a material with a density higher than the density of the material of the balance, the felloe being secured to the balance and having a central symmetry, the center of which is the geometric oscillation axis of the oscillator.

13. The rotating oscillator according to claim 12, wherein said oscillator has a circular perimeter concentric to the geometric oscillation axis.

14. The rotating oscillator according to claim 12, wherein the felloe defines a segmented or continuous ring.

15. The rotating oscillator according to claim 4, wherein the felloe and the inertia-blocks are made from the same material with a density higher than the material of the balance.

16. The rotating oscillator according to claim 14, wherein the felloe and the inertia-blocks are made from the same material with a density higher than the material of the balance.

17. The rotating oscillator according to claim 8, wherein the balance is made from silicon and the felloe is made from gold, the balance and the felloe being assembled by thermo-compression.

18. The rotating oscillator according to claim 15, wherein the balance is made from silicon and the felloe is made from gold, the balance and the felloe being assembled by thermo-compression.

19. The rotating oscillator according to claim 16, wherein the balance is made from silicon and the felloe is made from gold, the balance and the felloe being assembled by thermo-compression.

20. A micro-system implemented in an oscillator comprising:
a support element designed to allow the assembly of the oscillator on a timepiece;
a balance;
a plurality of flexible blades connecting the support element to the balance and able to exert a return torque on the balance;
wherein the plurality of flexible blades comprises at least two flexible blades, including a first blade positioned in a first plane perpendicular to the plane of the oscillator, and a second blade positioned in a second plane perpendicular to the plane of the oscillator and intersecting the first plane; a felloe mounted secured to the balance;
wherein the support element, the balance including the elastic elements, and the flexible blades are manufactured monolithically;
the first plane and the second plane the axis [sic] intersecting along the geometric oscillation axis of the oscillator, said geometric oscillation axis crossing the first and second blades at $7/8^{th}$ of their respective lengths; and
said oscillator being made from monolithic silicon.

* * * * *